United States Patent [19]

Nilssen

[11] Patent Number: 5,021,717

[45] **Date of Patent: * Jun. 4, 1991**

[54] OPERATING SYSTEM FOR MULTIPLE FLUORESCENT LAMPS

[76] Inventor: Ole K. Nilssen, Caesar Dr. Route 5, Barrington, Ill. 60010

[ * ] Notice: The portion of the term of this patent subsequent to Dec. 19, 2006 has been disclaimed.

[21] Appl. No.: 418,744

[22] Filed: Oct. 2, 1989

[51] Int. Cl.[5] ..... H05B 41/14; H05B 41/36

[52] U.S. Cl. ..... 315/324; 315/209 R; 315/256

[58] Field of Search ..... 315/209 R, 256, 324; 313/487; 331/113 A; 338/20; 363/50, 159, 172; 250/504 R

[56] References Cited

U.S. PATENT DOCUMENTS

| | | | |
|---|---|---|---|
| 4,045,711 | 8/1977 | Pitel | 313/209 R |
| 4,053,813 | 10/1977 | Kornrumpf et al. | 315/209 R |
| 4,184,128 | 1/1980 | Nilssen | 331/113 A |
| 4,188,661 | 2/1980 | Bower et al. | 363/49 |
| 4,277,726 | 7/1981 | Burke | 315/98 |
| 4,293,799 | 10/1981 | Roberts | 315/231 |
| 4,438,372 | 3/1984 | Zuchtriegel | 315/244 |
| 4,499,403 | 2/1985 | Leppelmeier et al. | 313/487 |
| 4,506,318 | 3/1985 | Nilssen | 363/132 |

*Primary Examiner*—David Mis

[57] ABSTRACT

A fluorescent lamp operating system comprises:

(i) a plurality of pairs of fluorescent lamps for providing luminous radiation, each pair of lamps being adapted to be powered from 30 kHz/120 Volt by way of a high-Q series-resonant L-C ballasting circuit;

(ii) a relatively low-power frequency converter connected with the power line and operable to provide power for heating the cathodes in these fluorescent lamps, thereby conditioning the lamps for easy starting;

(iii) a relatively high-power frequency converter also connected with a power line and operable to provide the 30 kHz/120 Volt required for operating the plurality of pairs of fluorescent lamps by way of the high-Q series-resonant L-C ballasting circuit; and (iv) delay means operable to prevent the 30 kHz/120 Volt provided by the high-power frequency converter from being applied to the fluorescent lamps until after power has been applied to heat the lamp cathodes for at least one second.

Each high-Q series-resonant L-C ballast circuit is protected from over-voltages by a Varistor, which acts as a substitute load in a case a lamp is removed or fails to operate properly. If current should flow through one of the Varistors for more than a few milli-seconds, the high-power frequency converter is disabled, thereby removing the 30 kHz/120 Volt.

28 Claims, 3 Drawing Sheets

OPERATING SYSTEM FOR MULTIPLE FLUORESCENT LAMPS

BACKGROUND OF THE INVENTION

1. Field of Invention

The present invention relates to a system for ballasting a plurality of fluorescent lamps.

2. Prior Art

Presently when ballasting a plurality of fluorescent lamps, such as in a sun tanning bed that typically comprises between 20 and 40 fluorescent lamps, with each lamp being 72" long and requiring about 100 Watt of power input for effective operation, these lamps are powered by way of a plurality of individual ballasts, with each ballast powering one or two lamps.

The fluorescent lamps most often used in these applications are of the so-called rapid-start type; which implies that each lamp requires four separate supply wires for proper operation. As a result, the number of wires required for powering 20-to-40 fluorescent lamps gets to be very high.

SUMMARY OF THE INVENTION

Brief Description

In its preferred embodiment, subject invention constitutes an operating system for a sun tanning apparatus. This operating system is adapted to be powered from an ordinary electric utility power line and comprises:

a) fluorescent lamps for providing luminous radiation, these lamps being arranged in the form of a plurality of separately identifiable lamp lamp-ballast assemblies, each such assembly having: i) a pair of fluorescent lamps, ii) a high-Q series-resonant L–C ballasting circuit operable to power the pair of lamps from 30kHz/120Volt, and iii) a first and a second set of assembly terminals, one set located at each end of the assembly;

b) a central frequency-converting power supply connected with said power line and having: i) a relatively low-power frequency converter operable to provide a first 30kHz/120Volt AC voltage for heating the cathodes in these fluorescent lamps, thereby to condition the lamps for easy starting, ii) a relatively high-power frequency converter operable to provide a second 30kHz/120Volt AC voltage for operating the plurality of lamp-ballast assemblies, and iii) a first and a second set of central terminals;

c) a first and a second distribution conductor means operable to provide connection between said first and second sets of central terminals and said first and second sets of assembly terminals; and iv) delay means operable to prevent the second 30kHz/120Volt AC voltage from being applied to the lamp assemblies until after the first 30kHz/120Volt AC voltage has had an opportunit to heat the lamp cathodes for at least one second.

DESCRIPTION OF THE PREFERRED EMBODIMENT

Details of Construction

Figure 1:
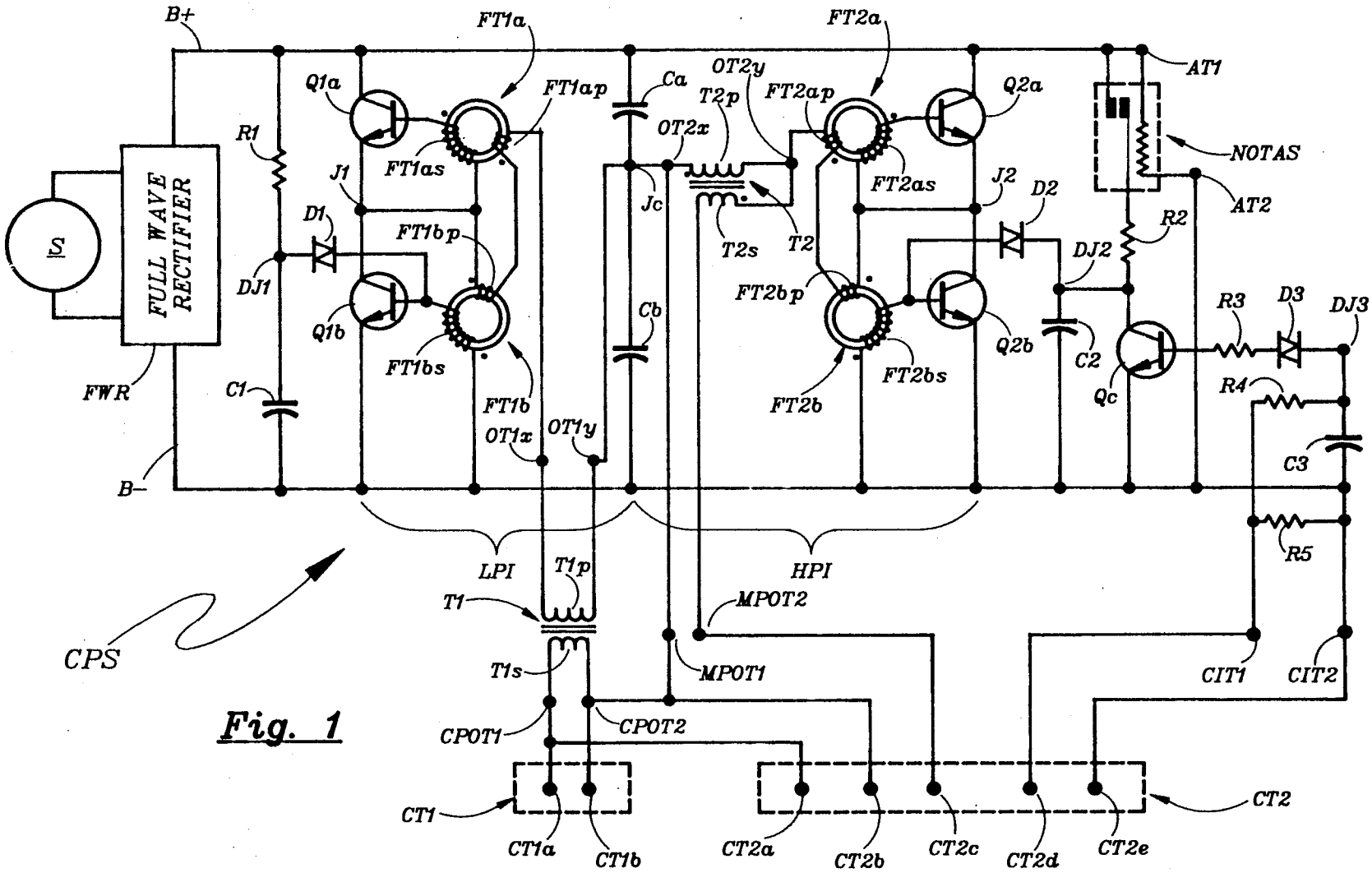
FIG. 1 provides a schematic illustration of the central frequency-converting power supply.

FIG. 1 shows an AC voltage source S, which in reality is an ordinary 120Volt/60Hz electric utility power line.

Connected to S is a full-wave rectifier FWR that rectifies the AC voltage from S to provide an unfiltered DC voltage between a positive power bus B+ and a negative power bus B−.

A first pair of transistors Q1*a* and Q1*b* are connected in series between the B+ bus and the B− bus in such a way that the collector of Q1*a* is connected to the B+ bus, the emitter of Q1*a* is connected with the collector of Q1*b* at a junction J1, and the emitter of Q1*b* is connected with the B− bus.

A second pair of transistors Q2*a* and Q2*b* are connected in series between the B+ bus and the B− bus in such a way that the collector of Q2*a* is connected to the B+ bus, the emitter of Q2*a* is connected with the collector of Q2*b* at a junction J2, and the emitter of Q2*b* is connected with the B− bus.

Primary winding FT1*ap* of saturable feedback transformer FT1*a* and primary winding FT1*bp* of saturable feedback transformer FT1*b* are connected in series between junction J1 and output terminal OT1*x*. Another output terminal OT1*y* is connected with junction JC between capacitors Ca and Cb; which capacitors are connected in series between the B+ bus and the B− bus.

Primary winding FT2*ap* of saturable feedback transformer FT2*a* and primary winding FT2*bp* of saturable feedback transformer FT2*b* are connected in series between junction J2 and output terminal OT2*y*. Another output terminal OT2*x* is connected with junction JC.

Secondary winding FT1as of feedback transformer FT1*a* is connected between the base and the emitter of transistor Q1*a;* and secondary winding FT1*bs* of feedback transformer FT1*b* is connected between the base and the emitter of transistor Q1*b*.

Secondary winding FT2*as* of feedback transformer FT2*a* is connected between the base and the emitter of transistor Q2*a*; and secondary winding FT2*bs* of feedback transformer FT2*b* is connected between the base and the emitter of transistor Q2*b*.

A resistor R1 is connected between the B+ bus and a junction DJ1; and a capacitor C1 is connected between junction DJ1 and the B− bus. A Diac D1 is connected between junction DJ1 and the base of transistor Q1*b*.

A series-combination of a normally-open thermally-activated switch NOTAS and a resistor R2 is connected between the B+ bus and a junction DJ2. This switch also has two auxiliary terminals AT1 and AT2 connected directly between the B+ bus and the B− bus. A capacitor C2 is connected between junction DJ2 and the B− bus. A Diac D2 is connected between junction DJ2 and the base of transistor Q2*b*.

A control transistor Qc is connected with its collector to junction DJ2 and its emitter to the B− bus. A series-combination of a resistor R3 and a Diac D3 is connected between a junction DJ3 and the base of transistor Qc. A capacitor C3 is connected between junction DJ3 and the B− bus. A resistor R4 is connected between junction DJ3 and first control input terminal CIT1. A resistor R5 is connected between first control input terminal CIT1 and a second control input terminal CIT2; which second control input terminal is connected with the Bbus.

Primary winding T1*p* of a transformer T1 is connected between inverter output terminals OT1*x* and OT1*y*. Secondary winding T1*s* is connected between cathode power output terminals CPOT1 and CPOT2.

Primary winding T2*p* of a transformer T2 is connected between inverter output terminals OT2*x* and OT2*y*. Secondary winding T2*s* is connected between terminal OT2*y* and a main power output terminal MPOT2. A main power output terminal MPOT1 is connected directly with inverter output terminal OT2*x*.

A first set of central terminals CT1 has two individual central terminals CT1*a* and CT1*b*; which terminals are connected with terminals CPOT1 and CPOT2, respectively.

A second set of central terminals CT2 has five individual central terminals CT2*a*, CT2*b*, CT2*c*, CT2*d* and CT2*e*. Of these terminals, CT2*a* and CT2*b* are connected with CPOT1 and CPOT2 respectively; CT2*b* and CT2*c* are connected with MPOT1 and MPOT2, respectively; and CT2*d* and CT2*e* are connected with CIT1 and CIT2, respectively.

The assembly consisting of transistors Q1*a* and Q1*b*, feedback transformers FT1*a* and FT1*b*, and output terminals OT1*x* and OT1*y* is referred to as low power inverter LPI. The assembly consisting of transistors Q2*a* and Q2*b*, feedback transformers FT2*a* and FT2*b*, and output terminals OT2*x* and OT2*y* is referred to as high power inverter HPI. The overall power supply of FIG. 1 is referred to as central power supply CPS.

Figure 2:
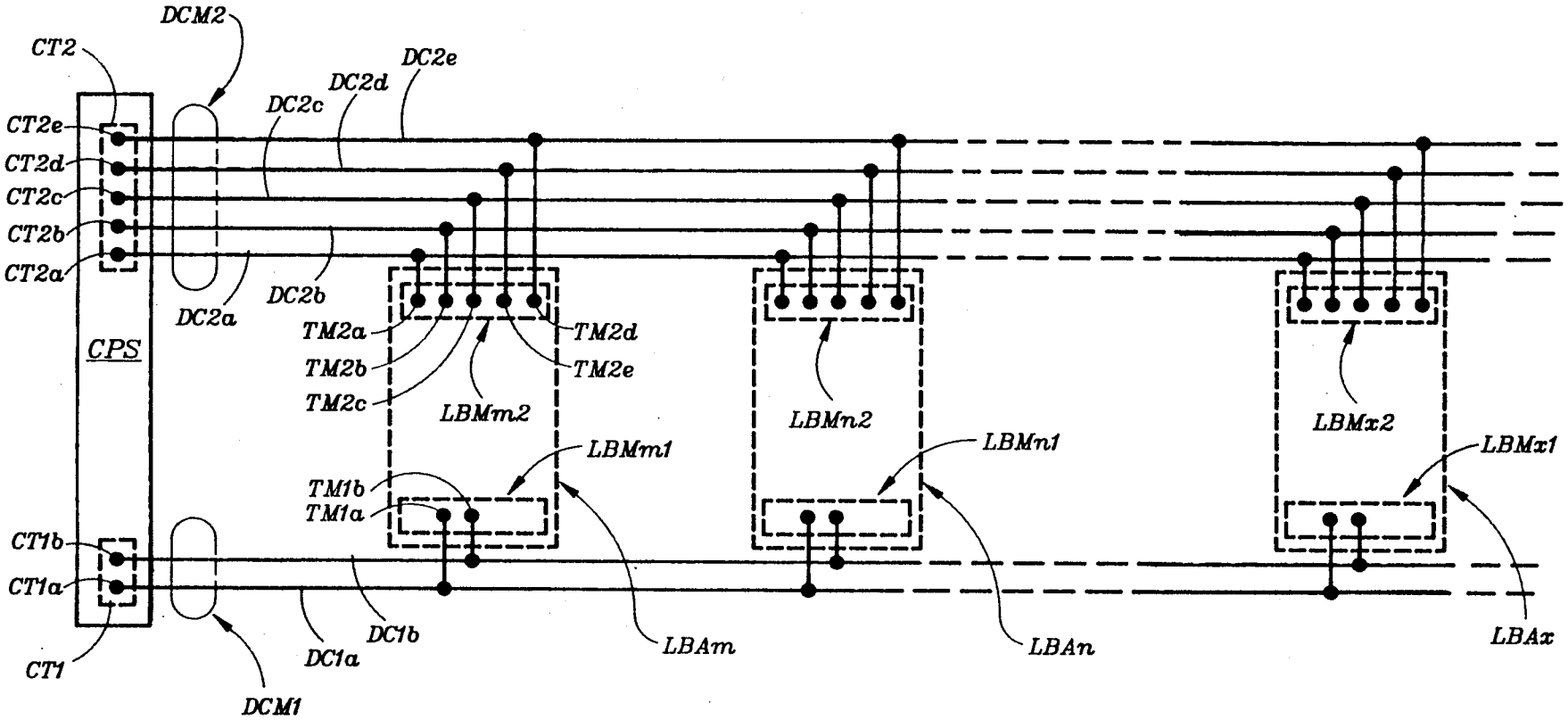
FIG. 2 diagrammatically describes the overall operating system in its preferred embodiment, including the central power supply, two sets of distribution conductors coming therefrom, and plural lamp-ballast assemblies connected between these two sets of distribution conductors.

FIG. 2 shows a first and a second set of distribution conductor means DCM1 and DCM2 connected respectively with the first and the second set of central terminals CT1 and CT2 on central power supply CPS.

The first set of distribution conductor means comprises two individual distribution conductors DC1*a* and DC1*b*; which are connected with central terminals CT1*a* and CT1*b*, respectively.

The second set of distribution conductor means comprises five individual distribution conductors DC2*a*, DC2*b*, DC2*c*, DC2*d* and DC2*e*; which are connected with central terminals CT2*a*, CT2*b*, CT2*c*, CT2*d* and CT2*e*, respectively.

Located between and connected with the two distribution conductor means DCM1 and DCM2, are a plurality of lamp-ballast assemblies LBAm, LBAn - - - - LBAx. Each lamp-ballast assembly comprises two lamp-ballast matching means: LBMm1 and LBMm2, LBMn1 and LBMn2 - - - - LBMx1 and LBMx2, respectively.

Lamp-ballast matching means LBMm1 has two terminals Tm1*a* and Tm1*b*; which are connected to distribution conductors DC1*a* and DC1*b*, respectively. Lamp-ballast matching means LBMm2 has five individual terminals Tm2*a*, Tm2*b*, Tm2*c*, Tm2*d* and Tm2*e*; which are connected to distribution conductors DC2*a*, DC2*b*, DC2*c*, DC2*d* and DC2*e*, respectively.

Similarly, lamp-ballast matching means LBMn1 has two terminals, lamp-ballast matching means LBMn2 has five terminals, lamp-ballast matching means LBMx1 has two terminals, and lamp-ballast matching means LBMx2 has five terminals; which terminals are all connected to individual distribution conductors in a manner that is analogous to the manner in which the terminals of lamp-ballast matching means LBNm1 and LBMm2 are connected.

Figure 3:
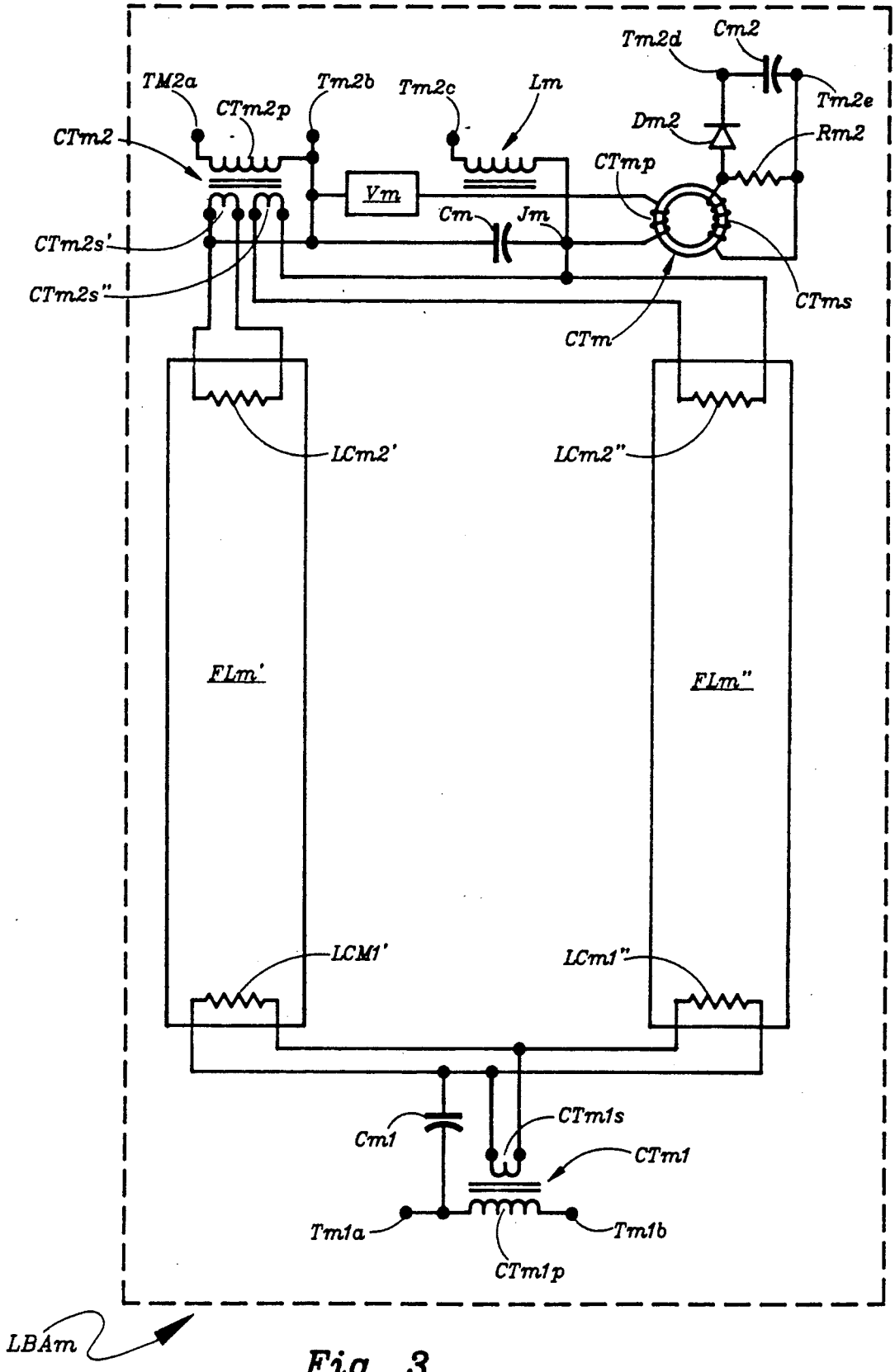
FIG. 3 provides schematic details of a lamp-ballast assembly.

FIG. 3 illustrates electric circuit details of lamp-ballast assembly LBAm.

A cathode transformer CTm1 has a primary winding CTm1*p* connected between terminals Tm1*a* and Tm1*b*; and it has a secondary winding CTm1*s* connected with the parallel-connected lamp cathodes LCml' and LCml'' of fluorescent lamps FLm' and FLm'', respectively.

A capacitor Cm1 is connected between terminal Tm1*a* and one of the terminals of secondary winding CTm1*s*.

A cathode transformer CTm2 has a primary winding CTm2*p* connected between terminals Tm2*a* and Tm2*b*; and it has two secondary windings CTm2*s*' and CTm2*s*'' connected with lamp cathodes LCm2' and LCm2'' of fluorescent lamps FLm' and FLm'', respectively.

An inductor Lm is connected between terminal Tm2*c* and a junction Jm; and a capacitor Cm is connected between junction Jm and terminal Tm2*b*. Also connected with terminal Tm2*b* is one of the terminals of lamp cathode LCm2'. A series-combination of a Varistor Vm and primary winding CTmp of a current transformer CTm is connected between terminal Tm2*b* and junction Jm. Secondary winding CTms of transformer CTm is connected between terminal Tm2*e* and the anode of a diode Dm2. The cathode of diode Dm2 is connected with terminal Tm2*d*. A capacitor Cm2 is connected between terminals Tm2*d* and Tm2*e*; and a resistor Rm2 is connected between terminal Tm2*e* and the anode of diode Dm2.

Details of Operation

The operation of the central power supply CPS of FIG. 1 may be explained as follows.

FIG. 1 shows two half-bridge inverters: a low power inverter LPI consisting of transistors Q1*a* and Q1*b* with their respective saturable positive feedback transformers FT1*a* and FT1*b*; and a high power inverter HPI consisting of transistors Q2*a* and Q2*b* with their respective saturable positive feedback transformers FT2*a* and FT2*b*.

Both inverters are capable of self-oscillation by way of positive feedback. When they do oscillate, the frequency of oscillation is about 30 kHz. For further explanation of the operation of this type of inverter, reference is made to U.S. Pat. Nos. 4,184,128 and 4,506,318, both issued to Nilssen.

Each of these inverters has to be triggered into oscillation; but they will only oscillate as long as the magnitude of the voltage between the B− bus and the B+ bus exceeds about 20 Volt. Thus, if one of the inverters is triggered into oscillation at the beginning of one of the sinusoidally-shaped DC voltage pulses existing between the B− bus and the B+ bus (as resulting from the unfiltered full-wave rectification of the voltage from the ordinary 120Volt/60Hz power line), that inverter will cease oscillating at the end of that DC voltage pulse. Thus, to keep either one of the inverters operating on a continuous basis, it is necessary that it be re-triggered at a rate of 120 times per second—i.e., once in the beginning of each half-cycle of the full-wave-rectified 120Volt/60Hz power line voltage.

Both the half-bridge inverters use capacitors Ca.and Cb to provide for an effective center-tap between the B− bus and the B+ bus—this center-tap being junction JC.

When power line voltage is initially applied to the arrangement of FIG. 1, inverter LPI will immediately commence operation, receiving the requisite trigger pulses by way of trigger assembly R1/C1/D1. The time-constant associated with R1/C1 is such as to cause the voltage on C1 to reach a level high enough for Diac D1 to break down within about one millisecond after the beginning of each sinusoidally-shaped pulse provided by the full wave rectifier. Inverter HPI, on the other hand, will not start receiving trigger pulses—and therefore will not commence operation—until after the normally-open thermally-activated switch NOVAS has closed. In the preferred embodiment, the time required for this switch to close is about 1.5 second. Thereafter, however, inverter HPI starts receiving trigger pulses by way of trigger assembly R2/C2/D2. As with inverter LPI, the time-constant associated with R2/C2 is such as to cause the voltage on C2 to reach a level high enough for Diac D2 to break down within about one millisecond after the beginning of each sinusoidally-shaped pulse provided by the full wave rectifier.

Thus, the time required for capacitors C1 and C2 to be charged to Diac breakdown voltages is arranged to be but a small fraction of the length of a half-cycle of the 60 Hz power line voltage; which implies that both inverters will be triggered into oscillation at the beginning of each of the 120 Hz DC pulses provided between the B− bus and the B+ bus.

As a result of the relatively short time-constants, repeated triggering will occur during each complete DC pulse. While most often such repeated triggering is of little consequence, it is sometimes desirable to avoid it altogether; which may be accomplished by adding a first diode between junction DJ1 and the collector of transistor Q1*b* and a second diode between junction DJ2 and the collector of transistor Q2*b*—in both cases with the anodes of the diodes being connected with the junctions.

By applying current to the base of control transistor Qc, the voltage on capacitor C2 can be prevented from rising to a level high enough to cause Diac D2 to break down, thereby removing the trigger signals from the base of transistor Q2*b*, which therefore prevents inverter HPI from being triggered into operation at the beginning of each of the 120 Hz DC voltage pulses provided between the B+ bus and the B− bus. Thus, the operation of inverter HPI can be controlled by way of a voltage applied to control input terminals CIT1 and CIT2. However, there is a time-constant involved: a voltage applied to terminals CIT1 and CIT2 will charge capacitor C3 by way of resistor R5. With the magnitude of the voltage applied between terminals CIT1 and CIT2 being about 40 Volts, it takes approximately 50 milli-second for capacitor C3 to reach a voltage high enough to cause Diac D3 to break down.

As soon as Diac D3 breaks down, base current is provided to control transistor Qc; which therefore starts conducting and thereby preventing capacitor C2 from charging up—thereby, in turn, preventing inverter HPI from being triggered. Even if the voltage between terminals CIT1 and CIT2 is then immediately removed, current will continue to flow into the base of Qc for some period of time. The length of this period is determined by the capacitance value of capacitor C3 as combined with the effective resistance value of R3 in series with D3. In the preferred embodiment, the length of this time period is approximately 30 seconds. After this time period, the conduction of Diac D3 ceases and base current is removed from Qc, thereby again permitting inverter HPI to be triggered by its triggering circuit R2/C2/D2.

The purpose of resistor R5 is that of providing a means for discharging capacitor C3 over a relatively long time period—such as several minutes. Its presence has only a minor effect on the 30 seconds time-constant associated with C3/D3/R3.

Thus, if a DC voltage of about 40 Volt is applied to terminals CIT1/CIT2 for a period of 50 milli-seconds or so, the high-power inverter becomes disabled; and it then remains disabled for a period of about 30 seconds. Thereafter, it resumes normal operation, which will last until a DC voltage of about 40 Volt is again provided to the CIT1/CIT2 terminals for some 50 milli-seconds.

In normal operation, both inverters will provide a relatively high-frequency (30 kHz) squarewave AC voltage 100% amplitude-modulated at a frequency of 120 Hz.

By way of transformer T1, the output from low-power inverter LPI is applied between central terminals CT1*a*/CT1*b*, as well as between central terminals CT2*a*/CT2*b*. By way of auto-transformer T2, the output from high-power inverter HPI is applied between central terminals CT2*b*/CT2c. Thus, central terminal CT2*b* acts as a common conductor for the output from both inverters.

With reference to FIG. 2, it is seen that central terminals CT1*a*/CT1*b* (CT1) and CT2*a*/CT2*b*/CT2*c*/CT2*d*/CT2*e* (CT2) are connected with distribution conductor means DCMI and DCM2, respectively; and, by way of these distribution conductor means, each and every one of the plurality of lamp-ballast assemblies is connected with these central terminals.

With reference to FIG. 3, it is noted that—by way of an isolating voltage transformer (ex: CTm1)—the voltage provided from central terminals CT1*a*/CT1*b* is used for heating two of the cathodes of the two fluorescent lamps in each lamp-ballast assembly.

Also, by way of a small capacitor (ex: Cm1), the voltage from central terminal CT1*a* is applied to the two connected cathodes (ex: LCm1′/LCm1″)—the purpose being that of aiding in the starting of the fluorescent lamps. (Since the frequency of inverter LPI is not exactly the same as that of inverter HPI, the phasing of the squarewave voltage across central terminals CT1*a* and CT1*b* varies in relationship to that of the squarewave voltage across central terminals CT2*b* and CT2c; which implies that, at least during part of the time, the voltage provided by distribution conductor means DCM1 adds to the voltage provided by distribution conductor means DCM2—as far as lamp starting voltage is concerned.)

By way of another isolating voltage transformer (ex: CTm2), the voltage provided from central terminals CT2*a*/CT2*b* is used for heating the other two cathodes (ex: LCm2′/LCm2″) of the two fluorescent lamps in each lamp-ballast assembly.

Thus, the two lamps (ex: FLm′/FLm″) in each lamp-ballast assembly are series-connected; and these series-connected lamps are connected in parallel with a capacitor (ex: Cm) to form a lamp-capacitor parallel-combination, which parallel-combination is connected in series with an inductor (ex: Lm) to form an overall series-tuned L-C circuit connected between those two of the lamp-ballast assembly's input terminals (ex: Tm2*b*/Tm2*c*) that are connected with central terminals CT2*b* and CT2*c*. Thus, this series-tuned L-C circuit being resonant at or near the fundamental frequency of the squarewave voltage provided between central terminals CT2*b* and CT2*c*, the overall arrangement provides for resonant ballasting wherein the resonant circuit is seriesexcited and parallel-loaded.

Both the capacitor and the inductor have relatively high Q-factors; which implies that there will be a substantial Q-multiplication effect. That is, absent any loading, the magnitude of the voltage developing across the capacitor will be larger by a factor of Q in comparison to the magnitude of the voltage applied to the series-resonant circuit. Since the net unloaded Q-factor of the L-C circuit in the preferred embodiment is over 100, the magnitude of the voltage developing across the capacitor—assuming linear operation and no breakdown—would reach 12,000 Volt with an input of 120 Volt.

However, the L-C circuit is loaded both by the two seriesconnected fluorescent lamps and the Varistor—the Varistor being in effect connected in parallel with the two series-connected lamps.

The clamping voltage of the Varistor is so chosen that—in the absence of the fluorescent lamps—the magnitude of the voltage developing across the capacitor is just right for proper rapid-starting of the two series-connected lamps.

With the Varistor chosen so as to clamp the voltage across the capacitor to a magnitude suitable for rapid-starting of the series-connected lamps, substantially no current will flow through the Varistor after the lamps have started. Moreover, the lamps will not start if the cathodes are non-incandescent.

Thus, when the lamps' cathodes are fully incandescent, the lamps will rapid-start in a matter of a few milli-seconds. However, due to the voltage-magnitude-limiting provided by the Varistor, with cold cathodes the lamps won't start at all.

If, in lamp-ballast assembly LBAm, for some reason the lamps should not start—perhaps because their cathodes had not yet reached incandescence, or perhaps because they were damaged, worn out, or otherwise inoperative, or perhaps because they were disconnected—Varistor Vm will conduct; and current will then flow through the primary winding of current transformer CTm. As a result, a 30 kHz voltage is developed across resistor Rm2; which voltage is rectified by diode Dm2, and the resulting unidirectional voltage is filtered by capacitor Cm2 and provided across terminals Tm2*d* and Tm2*e*, and thereby across central terminals CT2*d* and CT2*e*. The magnitude of this unidirectional voltage is about 40 Volt.

Operation of the Complete System

With reference to FIG. 1 and FIG. 3, the complete system of FIG. 2 operates as follows.

a) Upon initial application of power from the power line, inverter LPI immediately commences operation, thereby immediately starting to provide heating power to all the cathodes of all the fluorescent lamps in all of the plural lamp-ballast assemblies. Thus, within about 1.5 second after this initial application of power, all the lamp cathodes are incandescent.

b) About 1.5 second after initial application of power from the power line, inverter HPI commences operation, thereby providing operating power to all the fluorescent lamps. Since by now all the lamps have incandescent cathodes, lamp starting will take place within a few milli-seconds.

c) During the few milli-seconds before the lamps start, the L-C series-resonant ballasting circuits are each loaded with a Varistor, thereby preventing destructive over-voltages. While the Varistors are acting as loads, a DC control voltage of about 40 Volt magnitude is provided between control input terminals CIT1/CIT2. This voltage disappears as soon as the last pair of lamps start; which, under normal circumstances, will be well within 50 milli-seconds.

d) However, if—in one or more of the lamp-ballast assemblies—a pair of lamps should not start within about 50 milli-seconds, the 40 Volt DC voltage provided between control input terminals CIT1/CIT2 will cause inverter HPI to cease operation, thereby removing power from all the series-resonant L-C ballasting circuits.

e) At this point it should be noted that a Varistor—although it can absorb a very large amount of power for a brief period of time—can only absorb a miniscule amount of power on an average basis: a large-capacity Varistor is typically rated at about 1 Watt average power, although it may have a rating of more than 100 Joule in terms of energy-absorbing capacity. Thus, in subject system, a Varistor will indeed be able for 50 milli-second or so to safely absorb the approximately 400 Watt or power dissipation it is subjected to in case a pair of lamps fails to start—thereby absorbing a total amount of energy of about 20 Joule. However, within a maximum average power dissipation of 1 Watt, it would not be able to absorb such an amount of energy more often than once every 20 seconds.

f) Due to the resonant nature of the ballasting circuits, the current flowing into each lamp-ballast combination will be substantially sinusoidal in waveshape even though the driving voltage is a squarewave.

g) The fundamental nature of a high-Q resonant series-excited L-C circuit that is parallel-loaded with a gas discharge lamp, is one of providing this lamp with current from the near-equivalent of an ideal eurrent source, with the magnitude of the current provided to the lamp being roughly proportional to the magnitude of the driving voltage, and the magnitude of the power being provided to the lamp being roughly proportional to the magnitude of the voltage present across the lamp.

As an overall result, the RMS magnitude of the current drawn from central power supply CPS by the plurality of lamp-ballast assemblies will be roughly proportional to the RMS magnitude of the squarewave voltage provided by this central power supply; which, since this squarewave voltage is amplitude-modulated in direct proportion to the instantaneous magnitude of the DC voltage provided from the full wave rectifier, implies that the magnitude of the instantaneous current drawn by the central power supply from the power line will be roughly proportional to the instantaneous magnitude of the voltage provided therefrom. Thus, the power factor by which the central power supply draws power from the power line will be high—approaching 100%.

h) The amount of power that has to be provided by the low-power inverter LPI is less than 10% of the amount of power that has to be provided by high-power inverter HPI.

i) The fluorescent lamps are started in a particularly gentle rapid-start fashion: the cathodes are allowed to reach full incandescence before lamp operating voltage is applied; and lamp starting aid is provided both by way of a starting capacitor (ex: Cm1 in FIG. 3) and by way of providing a ground-plane next to each lamp. (The ground-plane is not shown, but is indeed present by way of a grounded reflector means mounted directly behind all the lamps.)

j) For extra high power levels, it would be advantageous to use a full-bridge arrangement (instead of the half-bridge arrangement shown) for high-power inverter HPI. That way, 30 kHz/120Volt would be provided directly from the inverter -without any need for using a voltage transformer at the output.

k) Because the lamp supply voltage is removed within a few milli-seconds if a fluorescent lamp is disconnected from the circuit, the lamp-ballast arrangement of FIG. 3 exhibits a high degree of safety from electric shock hazard.

Additional Comments

Otherwise, the following points should be noted.

1) Capacitors Ca and Cb of FIG. 1 are sized such as not to store a significant amount of energy in comparison to the amount of energy drawn by the central power supply during one complete half-cycle of the 120 Volt/60 Hz power line voltage, while at the same time to store an amount of energy that is several times as large as the amount of energy used by the inverters during one half-cycle of the 30 kHz inverter output voltage.

m) Extra high operating efficiency can be achieved by removing the externally supplied cathode heating power once the lamps have started. This may be simply accomplished by disabling low-power inverter LPI as soon as high-power inverter HPI commences operation.

n) The power supplied to the fluorescent lamps depends on the timing or phasing of the trigger pulses provided to high-power inverter HPI. In turn, the timing of these trigger pulses depend on the delay associated with the process of charging capacitor C2 to a voltage high enough to cause breakdown of Diac D2. The length of this delay can be adjusted over a wide range by adjusting the resistance value of R2.

o) Instead of using two separate inverters (ex: LPI and HPI), a single inverter may be used—with switch means operable to provide the requisite delay in applying the 30 kHz/120 Volt operating power to the lamps.

p) In addition to and/or instead of disabling inverter HPI in response to an over-voltage condition in one or more of the lamp-ballast assemblies, such inverter disabling could also be done in response to any number of other fault conditions (such as excess ground-fault current) and then using the same pair of distribution conductors (i.e., DC2*d* and DC2*e*) for conveying an appropriate disable signal to the central power supply.

q) It is noted that distribution conductors DC1*a*, DC1*b* and DC2*a* may be totally eliminated, yet the system would still be operable, albeit that the fluorescent lamps would then operate in an instant-start manner.

r) It is believed that the present invention and its several attendant advantages and features will be understood from the preceding description. However, without departing from the spirit of the invention, changes may be made in its form and in the construction and interrelationships of its component parts, the form herein presented merely representing the presently preferred embodiment.

I claim:

1. In a lighting apparatus adapted to be powered from an ordinary electric utility power line, the improvement comprising:

central power supply connectable with said power line and operable to provide at a first output a first AC voltage and at a second output a second AC voltage, said power supply having a control input and being operative to reduce the magnitude of said first AC voltage after having received at said control input a control signal for longer than a certain period of time, said first and second outputs and said control input being connected with a set of central terminals;

a plurality of lamp-ballast assemblies, each such assembly having: (i) a set of at least four assembly terminals, (ii) a fluorescent lamp means having thermionic cathodes and a pair of main lamp power input terminals, each cathode having a pair of cathode terminals, (iii) transformer means connected in circuit between a first pair of said assembly terminals and said cathode terminals, (iv) an L–C series-circuit having an inductor means and a capacitor means and being resonant at or near the frequency of said second AC voltage, said L–C series-circuit being connected across a second pair of said assembly terminals, said main lamp power terminals being effectively connected in parallel with said capacitor means, (v) voltage-clamping means effectively connected in parallel with said capacitor means and operative to cause clamping of the voltage developing thereacross so as to prevent its magnitude from becoming excessively large, and (vi) sensing means connected with the voltage-clamping means and operative to provide said control signal at a control output whenever said voltage-clamping means acts to cause said clamping, said control output being connected with a third pair of said assembly terminals, and distribution conductor means operative, for each lamp-ballast assembly, to provide connection between said central terminals and said assembly terminals;

whereby the central power supply is operative to: (i) provide cathode heating power to said cathodes, (ii) provide lamp operating power to said lamp means, and (iii) reduce the magnitude of said first AC voltage if in any one of the plurality of lamp-ballast assemblies said clamping occurs for longer than said certain period of time.

2. The improvement of claim 1 wherein the fundamental frequency of said second AC voltage is substantially higher than that of the voltage provided by said power line.

3. The improvement of claim 1 wherein the length of said certain period of time is on the order of 50 milliseconds.

4. The improvement of claim 1 wherein, upon initially connecting the central power supply with the power line, said first AC voltage is provided at said first output substantially without delay, whereas said second AC voltage is provided at said second output after a pre-determined delay.

5. The improvement of claim 4 wherein the length of said pre-determined delay is on the order of 1.5 second, thereby providing for sufficient time for the cathodes to reach incandescence before applying lamp operating power to the lamp means by way of said main lamp power terminals.

6. The improvement of claim 1 wherein said second AC voltage is an amplitude-modulated squarewave voltage of fundamental frequency substantially higher than that of the voltage on said power line.

7. A lighting system adapted to be powered from an ordinary electric utility power line and comprising:

a power supply connectable with the power line and operable to provide a first and a second AC voltage at a set of supply terminals;

a plurality of lamp-ballast assemblies, each such assembly having: (i) a set of assembly terminals, (ii) a fluorescent lamp means having thermionic cathodes connected with a set of lamp terminals, said lamp means also having a pair of main lamp power input terminals connected with the set of lamp terminals, (iii) a transformer means connected in circuit between said assembly terminals and said lamp terminals, and (iv) a ballast means connected between said assembly terminals and said main lamp power input terminals; the transformer means of one of said lamp-ballast assemblies being magnetically non-coupled with the transformer means of each other one of said lamp-ballast assemblies; and connect means operative to connect the supply terminals with the assembly terminals of each lamp assembly;

whereby cathode heating power is provided from the first AC voltage by way of the transformer means and lamp operating power is provided from the second AC voltage by way of the ballast means.

8. The lighting system of claim 7 wherein the frequency of the first AC voltage at a given point in time is different from that of the second AC voltage.

9. The lighting system of claim 7 wherein, upon connecting the power supply with the power line, the first AC voltage is provided substantially without delay, whereas the second AC voltage is provided after a pre-determined delay.

10. The lighting system of claim 9 wherein the duration of the pre-determined delay is on the order of 1.5 second.

11. The lighting system of claim 7 wherein said ballast means comprises a L–C series-circuit connected between two of the assembly terminals and resonant at or near the frequency of the second AC voltage.

12. A lamp-ballast assembly adapted to be powered from an AC voltage of frequency substantially higher than that of the voltage on an ordinary electric utility power line, said assembly comprising:

a set of assembly terminals operable to connect with the AC voltage;

fluorescent lamp means having: (i) thermionic cathodes connected with a set of lamp terminals, and (ii) a pair of main lamp power input terminals connected with the lamp terminals;

transformer means connected between the assembly terminals and the lamp terminals; the transofrmer means being operative to provide cathode heating power to the thermionic cathodes; and ballast means connected in circuit between the assembly terminals and the main lamp powder input terminals, the ballast means having an inductor means that is magnetically non-coupled with the transformer means and operative, when the assembly is connected with the source, to provide magnitude-limited alternating current to the main lamp power input terminals.

13. The assembly of claim 12 wherein said ballast means comprises an L–C series-circuit connected across two of the assembly terminals, said L–C series-circuit having an inductor means and a capacitor means and being series-resonant at or near the frequency of said AC voltage, the lamp means being effectively connected in parallel with the capacitor means.

14. A lighting system adapted to be powered from an ordinary electric utility power line and comprising:

a power supply having an AC voltage output and a control signal input, the magnitude of said AC voltage being reduced by a control signal received at said control signal input;

a plurality of fluorescent lamp-ballast assemblies, each such assembly having: (i) at least three assembly terminals, (ii) a fluorescent lamp means having lamp terminals, (iii) ballast means connected in circuit between a first pair of said assembly terminals and said lamp terminals, and (iv) sensor means connected with a second pair of said assembly terminals and operative to sense a certain condition in respect to the operation of said assembly and to produce a control signal in response thereto; and connect means operative to provide, for each lamp-ballast assembly, connection between said AC voltage output and said first pair of assembly terminals, and between said control signal input and said second pair of assembly terminals;

whereby the magnitude of said AC voltage is reduced by the provision of a control signal from any one of said lamp-balast assemblies in response to said certain condition, but only as long as said control signal is indeed being produced.

15. A lighting system adapted to be powered from the AC voltage on an ordinary electric utility power line and comprising:

rectifier means connected with said power line and operative to provide a DC voltage across a pair of DC terminals, the instantaneous absolute magnitude of said DC voltage being substantially equal to that of said AC voltage;

inverter means connected with said DC terminals and operative during certain time periods to convert said DC voltage into a squarewave voltage provided at a squarewave output, the instantaneous absolute magnitude of this squarewave voltage being substantially proportional to that of the DC voltage during said certain times;

a plurality of lighting assemblies, each such assembly having an electric lamp means connected with a pair of assembly terminals; and distribution conductor means connected with said squarewave output as well as with the pair of assembly terminals on each lighting assembly.

16. The lighting system of claim 15 wherein said inverter comprises control means operative to permit control of the duration of said time periods.

17. The combination of a sun tanning apparatus with an electronic fluorescent lamp operating system, wherein:

a) the sun tanning apparatus comprises:

a plurality of fluorescent lamp means, each lamp means: (i) having a pair of thermionic cathodes, (ii) being operative to provide photic radiation suitable for beneficially affecting human skin exposed thereto, and (iii) requiring for proper operation that a current-limited voltage be applied between said cathodes; and b) the lamp operating system comprises:

frequency converter means connected with an ordianry electric utility power line and operative to provide a squarewave AC voltage at an AC output, said AC voltage having a fundamental frequency substantially higher than that of the voltage on said power line; and for each one of said plurality of fluorescent lamp means, a ballasting means connected with said AC output and operative to provide said current-limited voltage, said ballasting means comprising L-C circuit means resonant at or near said fundamental frequency as well as transformer means operative to provide cathode heating power to the thermionic cathodes; the transformer means being magnetically non-coupled with the L-C circuit means;

whereby, from a single frequency converter means, each one of said plurality of fluorescent lamp means is provided with an alternating and essentially sinusoidal current of frequency substantially higher than that of the voltage on said power line.

18. The combination of claim 17 wherein said L-C circuit comprises an inductor and a capacitor, said inductor and capacitor being effectively series-connected across said AC output, said lamp means being effectively parallel-connected with said capacitor.

19. The combination of claim 17 wherein each one of said lamp means comprises at least two individual fluorescent lamps.

20. The combination of claim 19 wherein said individual fluorescent lamps are connected in series.

21. The combination of:

a) sun tanning means comprising:

a plurality of fluorescent lamp means, each lamp means: (i) having two thermionic cathodes, each cathode having a pair of cathode terminals, and (ii) being operative, when provided with a relatively low-magnitude cathode heating voltage across each pair of cathode terminals as well as a relatively high-magnitude current-limited lamp operating voltage between said cathodes, to provide photic radiation operative to beneficially affect human skin exposed thereto; and b) lamp operating system comprising:

first power supply means adapted to connect with an ordinary electric utility power line and operative to provide a first AC voltage at a first output, the first AC voltage being of frequency substantially higher than that of the AC voltage on an ordinary electric utility power line;

second power supply means adapted to connect with said power line and operative to provide a second AC voltage at a second output; the second AC voltage being of frequency substantially higher than that of the AC voltage on an ordinary electric utility power line; the second power supply means being operable to provide the second voltage even at times when the first power supply means may not provide the first voltage;

for each one of said plurality of fluorescent lamp means, a ballasting means connected with both of said outputs and operable to provide said low-magnitude carhode heating voltage as welel as said high-magnitude current-limited lamp operating voltage.

22. The combination of claim 21 wherein said second power supply means comprises control means operative selectively to provide or non-provide said second voltage, irrespective of the presence of said first voltage.

23. The combination of:

a) sun tanning means comprising:

a plurality of flurescent lamp means, each lamp means: (i) having two thermionic cathodes, and (ii) being operative, when provided with a suitable current-limited voltage between said cathodes, to provide photic radiation operative to beneficially affect human skin exposed thereto; and b) lamp operating system comprising:

rectifier means adapted to connect with an ordinary electric utility power line and operable to provide a DC voltage at a DC output;

inverter means connected with said DC output and controllably operable to provide an AC voltage at an AC output, said AC voltage being of frequency substantially higher than that of the voltage on said power line, said inverter means having control means operative, on receipt of a control signal, to remove said AC voltage from said AC output; and for each one of said plurality of fluorescent lamp means, a ballasting means connected with said AC output and operable to provide said suitable current-limited voltage between the cathodes of said one fluorescent lamp means;

such that, whenever said rectifier means is connected with said power line, except during periods when receiving said control signal, each one of said plurality of fluorescent lamp means is provided with said suitable current-limited voltage between its cathodes.

24. An arrangement comprising:

a power supply means connected with an ordinary electric utility power line; the power supply means: (i) being operative to provide an AC voltage at a pair of output terminals; and (ii) having control means operative, a brief period after receiving a control signal at a control input, to substantially reduce the magnitude of the AC voltage; and an assembly including (i) a fluorescent lamp means including at least two series-connected fluorescent lamps, each having two thermionic cathodes and four lamp terminals; (ii) ballasting means connected in circuit between said output terminals and said four lamp terminals; and (iii) sensor means connected in circuit with the lamp terminals and operative, in case two of the lamp terminals were to be disconnected from said ballasting means, to provide said control signal, thereby to substantially reduce the magnitude of the AC voltage.

25. The arrangement of claim 24 wherein the assembly includes a tank capacitor disconnectably connected in series with a tank inductor, thereby to form a tuned L-C circuit resonant at or near the frequency of the AC voltage.

26. An arrangement comprising:

a power supply operative to be connected with an ordinary electric utility power line and, when so connected, being operative to provide an AC voltage at a pair of AC terminals; the power supply having control means with control terminals; the control means being operative, a brief period after having received a control signal at the control terminals, to substantially reduce the magnitude of the AC voltage;

circuit means connected between the AC terminals and four socket terminals;

a fluorescent lamp having two thermionic cathodes and four lamp terminals; the lamp terminals being disconnectably connected with the socket terminals; whereby, as ong as the lamp terminals are connected with the socket terminals: (i) cathode heating power will be provided to the thermionic cathodes; (ii) the fluorescent lamp will ignite, but not before the thermionic cathodes have become thermionic; and iii) the magnitude of the cathode heating power provided will be substantially the same before lamp ignition as compared with after lamp ignition; and sensor means having sensor input terminals and sensor output terminals; the sensor input terminals being connected in circuit with the lamp terminals; the sensor output terminals being connected in circuit with the control terminals; the sensor means being operative to provide the control signal in the event that two of the lamp terminals were to be disconnected from two of the socket terminals;

whereby, if two of the four lamp terminals were to be disconnected, the control signal would be provided and the magnitude of the AC voltage would be substantially reduced.

27. The arrangement of claim 26 wherein the sensor output terminals are electrically isolated from the sensor input terminals; such that no electrical current can flow between one of the sensor output terminals and one of the sensor input terminals.

28. The arrangement of claim 26 wherein said brief period of time is less than about 100 milli-seconds.

* * * * *